US008439046B2

(12) United States Patent
Peters et al.

(10) Patent No.: US 8,439,046 B2
(45) Date of Patent: May 14, 2013

(54) FILTER CIGARETTE

(75) Inventors: Gunther Peters, Buchholz (DE); Paul-Georg Henning, Quickborn (DE); Thomas Pienemann, Rosengarten (DE); Henning Seidel, Mechtersen (DE)

(73) Assignee: Reemtsma Cigarettenfabriken GmbH, Hamburg (DE)

( * ) Notice: Subject to any disclaimer, the term of this patent is extended or adjusted under 35 U.S.C. 154(b) by 1031 days.

(21) Appl. No.: 11/815,284

(22) PCT Filed: Jan. 16, 2006

(86) PCT No.: PCT/EP2006/000326

§ 371 (c)(1), (2), (4) Date: Apr. 15, 2008

(87) PCT Pub. No.: WO2006/081931

PCT Pub. Date: Aug. 10, 2006

(65) Prior Publication Data

US 2009/0020132 A1 Jan. 22, 2009

(30) Foreign Application Priority Data

Feb. 1, 2005 (DE) ..... 10 2005 005 175

(51) Int. Cl.
*A24F 1/00* (2006.01)

(52) U.S. Cl.
USPC ..... 131/200; 131/331

(58) Field of Classification Search ..... 131/344, 131/331, 200
See application file for complete search history.

(56) References Cited

U.S. PATENT DOCUMENTS

| | | | | | |
|---|---|---|---|---|---|
| 3,413,982 | A * | 12/1968 | Sublett et al. | ..... | 131/343 |
| 3,658,070 | A * | 4/1972 | Diluzio | ..... | 131/334 |
| 5,033,484 | A * | 7/1991 | Seidel et al. | ..... | 131/364 |
| 5,671,757 | A * | 9/1997 | Woodings | ..... | 131/331 |
| 5,921,249 | A * | 7/1999 | Hampl, Jr. | ..... | 131/365 |
| 6,789,547 | B1 * | 9/2004 | Paine, III | ..... | 131/334 |
| 6,789,548 | B2 * | 9/2004 | Bereman | ..... | 131/352 |
| 6,805,134 | B2 * | 10/2004 | Peele | ..... | 131/299 |
| 2003/0200973 | A1 | 10/2003 | Xue et al. | | |
| 2006/0130862 | A1 * | 6/2006 | Dittrich et al. | ..... | 131/364 |

FOREIGN PATENT DOCUMENTS

| | | | |
|---|---|---|---|
| DE | 3837930 | C1 | 9/1989 |
| DE | 4030316 | A1 | 4/1991 |
| DE | 4205658 | A1 | 8/1993 |
| WO | 0049901 | A1 | 8/2000 |
| WO | 0237990 | A2 | 5/2002 |
| WO | 03015544 | A1 | 2/2003 |
| WO | 2004103099 | A2 | 12/2004 |

OTHER PUBLICATIONS

Office Action dated Aug. 11, 2006 from priority application (German Application Serial No. 102005005175.8).

* cited by examiner

*Primary Examiner* — Richard Crispino
*Assistant Examiner* — Dionne Walls Mayes
(74) *Attorney, Agent, or Firm* — Hovey Williams LLP

(57) ABSTRACT

In a filter cigarette having a tobacco strand, a wrapping and a filter, the filter possesses at least one gas phase-active filter part which contains at least one gas phase-reducing substance. The gas phase-reducing substances are embedded in a filter material matrix. They are introduced in a quantity of at least 75 mg per filter and at least 5 mg/mm of the length of the gas phase-active filter part. The filter cigarette exhibits a filter ventilation of at most 30% (or of from 30% to 70%). The NFDPM value is between 4 and 10 mg/cigarette (or in the range of from 2 to 4 mg/Cigarette), as measured in accordance with ISO smoking conditions. The gas phase quotient Q1, defined as (μg of benzene per cigarette)/(mg of CO per cigarette) and measured in accordance with ISO smoking conditions, is less than 1.5, preferably less than 1.

26 Claims, No Drawings

FILTER CIGARETTE

CROSS REFERENCE TO RELATED APPLICATIONS

This is a National Phase Application pursuant to 37 C.F.R. §371 of International Application No. PCT/EP2006/000326, filed Jan. 16, 2006, claiming priority of German Application No. DE 10 2005 005 175.8, filed Feb. 1, 2005, both of which are hereby incorporated by reference herein.

BACKGROUND OF THE INVENTION

1. Field of the Invention

The invention relates to a filter cigarette.

2. Discussion of Prior Art.

The smoke of cigarettes is composed of a particle phase and a gas phase. In many filters which are employed conventionally, cellulose acetate is used for filtering the smoke. The gas phase is often not reduced to a satisfactory degree in this connection, for which reason other constructional features are also frequently adjusted. For example, it is customary to provide cigarettes with relatively high ventilation, with this resulting in the gas phase additionally being diluted with air. Another possibility for additionally reducing the gas phase is that of using gas phase-active, that is gas phase-reducing, substances in the filter. In order to determine the gas phase substances in cigarette smoke, cigarettes are usually smoked in accordance with the ISO Standard. If alternative smoking conditions are chosen, for example if the cigarettes are smoked under intense smoking conditions (see definitions below) as is customary in Canada, the gas phase values are markedly higher.

The prior art discloses filter cigarettes which use gas phase-active substances to influence the tobacco smoke so as to reduce the quantity of gas phase in the mainstream smoke which is inhaled by the smoker.

For example, filter cigarettes whose gas phase values are reduced by adding gas phase-active substances such as active charcoal are on the market. Active charcoal filters, in which the active charcoal is introduced into a chamber, have been frequently employed for a long time, in particular in Japan, and are disclosed in WO 02/37990 A2 or in other documents such as DE 42 056 58 A1 or WO 00/49901 A1.

In the case of the product "Advance", the filter consists of a filter segment containing active charcoal and a filter segment containing ion exchange resins as well as, optionally, a mouth-end filter segment composed of cellulose acetate. Comparable cigarettes are described in WO 03/015544 A1 and WO 2004/103099 A2.

The gas phase reduction is furthermore influenced by the combination of the design parameters of a filter cigarette, with these design parameters including not only the filter additives but also the constitution of the tobacco, of the wrapping material and of the filter components.

However, a feature possessed in common by all the above-mentioned previous uses and previous descriptions is that the gas phase is not reduced to a satisfactory extent in the cigarettes which are described. In the case of cigarettes which are customary in the market, the values for the total gas phase content $G_{tot}$ (see below) are greater than 1200 μg/cigarette, as measured in accordance with ISO.

A high gas phase reduction is often only achieved using very high ventilation, with this then resulting in the gas phase values being extremely elevated when they are determined under intense smoking conditions.

Another disadvantage is that, after a certain storage time, conventional gas phase-active cigarette filters lose efficacy.

Other substances are frequently added either to the tobacco mixture or the filter in the case of cigarettes of the prior art, with palladium, for example being added to the tobacco as in WO 02/37990 A1. The high costs and aggravated manufacturing conditions are disadvantageous in this connection.

Elaborate and expensive multifilter constructions, involving a large number of different adsorbents or expensive special materials, are also disadvantageous.

SUMMARY

The object of the invention is to create a filter cigarette in which the gas phase in the tobacco smoke is significantly reduced. This gas phase reduction should also occur under what are termed intense smoking conditions (see below). The gas phase efficiency of the filter should, if at all possible, be constant, or at least only change to a slight extent, over a relatively long period, for example the period during which the cigarettes are stored.

This object is achieved by means of a filter cigarette comprising a tobacco rod, a wrapping, and a filter. The filter includes at least one gas phase-active filter part which contains at least one gas phase-reducing substance, with the at least one gas phase-active filter part presenting a length. The at least one gas phase-reducing substance is embedded in a filter material matrix. The at least one gas phase-reducing substance is introduced in such a quantity that the filter cigarette has a high substance load of at least 75 mg per filter and at least 5 mg/mm of the length of the at least one gas phase-active filter part. Any filter ventilation exhibited by the filter cigarette is less than or equal to 30%. The filter cigarette has an NFDPM value between 4 and 10 mg/cigarette, as measured in accordance with ISO smoking conditions. The filter cigarette has a gas phase quotient Q1, defined as (μg of benzene per cigarette)/(mg of CO per cigarette) and measured in accordance with ISO smoking conditions, less than 1.5. The tobacco rod includes tobacco dry matter. Any additives contained within the tobacco rod result in the tobacco rod having an additive content of less than 1% based on the tobacco dry matter. Advantageous embodiments of the invention ensue from the subclaims.

DETAILED DESCRIPTION OF THE PREFERRED EMBODIMENT

The filter cigarette according to the invention has a tobacco strand, a filter and a wrapping (preferably composed of cigarette paper, filter wrapping paper and filter joining paper). The filter contains a filter material matrix containing gas phase-reducing substances.

The tobacco in the tobacco strand preferably consists of an American Blend mixture or a Virginia mixture. The tobaccos in the tobacco mixture are preferably provided with an additive content of less than 1% of non-volatilizable constituents, based on the tobacco dry matter; in particular preference is given to using no additives. The tobaccos are preferably selected such that the TSNA (TSNA: tobacco-specific nitrosamines) content of the total mixture is less than 2 μg/g of tobacco. It is even more advantageous if the content of TSNA in the tobacco is less than 1 μg/g of tobacco.

The tobacco can contain additives such as casing, flavouring agents, humectants, sugar, cocoa, liquorice and menthol.

The cigarette paper which surrounds the tobacco strand is preferably porous and has a porosity of more than 40 CU (Coresta units) or more than 60 CU. In order to achieve particularly low NFDPM values (see below) in the range of 4-7 mg/cigarette, the porosity is preferably greater than 300 CU. For this, the cigarette paper, which is naturally porous, can additionally be electro perforated, mechanically perforated or laser-perforated.

The cigarette paper preferably contains a relatively high content of glow salt for the purpose of reducing the CO content in the smoke. Customary glow salt quantities are at 0.7%. According to the invention, glow salt quantities of 1.3% or more, preferably 2% are used. Preference is given to using sodium/potassium citrates.

In one embodiment, the grammage of the cigarette paper is preferably lower than in the case of comparable conventional cigarettes and is 22 g/cm$^2$.

The filter can consist, for example of one, two, three, four or five filter sections and preferably has two filter sections. If the filter has more than one filter section, a filter section which does not contain any gas phase-reducing substances is preferably arranged at the mouth end. Different gas phase-reducing substances can be introduced in one filter part or in different filter parts. When several filter parts are present, they can be arranged longitudinally one after the other or else arranged coaxially.

The filter material (the matrix and other material as well) contains, for example, cellulose, cellulose derivatives (preferably cellulose acetate), and polymers such as polyolefins (polypropylene, polyethylene), polyesters, or mixtures thereof.

The filter material consists, for example, of fibres, tow, paper, textile web, non-woven material, fibrous web, extrudate and/or foam.

Before being shaped into the filter form, the filter material is preferably shrunk and treated and/or provided with further filter additives such as catalysts or taste-influencing additives, such as flavours or sugars.

The gas phase-reducing substances are introduced into a filter material matrix (e.g. interspersed or by means of an airlaid process), specifically in a quantity of at least 75 mg per filter and at least 5 mg/mm of the length of the gas phase-active filter part.

Examples of gas phase-reducing substances which can be used are active charcoal, aluminium oxide, aluminium hydroxide, ion exchangers (preferably ion exchange resins), molecular sieves, silica gel or natural or synthetic materials such as magnesium silicate, argillaceous earth, zeolites, bentonites, kieselguhr or sepiolite. The gas phase-reducing substances which are introduced into the filter preferably have a high surface area in the region of more than 1000 m$^2$/g, preferably 1000-1.200 m$^2$/g, as measured by the BET method, and/or an uptake of $CCl_4$ of 60%-70% based on the proper weight of the gas phase-reducing substance.

The filter wrapping paper wraps the filter parts. It can be porous or nonporous. The filter joining paper or binding paper connects the filter to the tobacco strand. It can be naturally porous, mechanically perforated or electroperforated or laser-perforated.

To produce the filter ventilation, the filter is preferably laser-perforated online, that is during the production of the cigarette and after the filter has been attached to the tobacco strand. The filter ventilation is between 0% and 30% and is preferably between 10% and 25%. In other embodiments, the filter ventilation is in the range of 30% to 70%, preferably in the range of 30% to 60%.

In the following, some terms are clarified or defined so as to enable the invention to be better understood.

The gas phase of the cigarette smoke is a complex substance mixture composed of permanent gases, such as $N_2$ and $CO_2$ as well as a large number of readily volatile and medium-volatile compounds. Some of these components have been associated with the effects of smoking on health. Thus, formaldehyde, prussic acid and benzene, for example, are mentioned in the cigarette pack warning notices which are stipulated in Germany.

The content of many readily volatile and medium-volatile compounds in the smoke can be reduced by using gas phase-reducing substances (in particular adsorbents) such as active charcoal. On the other hand, the content of permanent gases such as CO remains largely unaltered. A measurable variable which describes the efficacy of these adsorbents in a manner which is as far as possible not subject to the influence of other construction features should be found for characterizing this effect.

For this purpose, the influence of different parameters on the quantity and composition of the gas phase was investigated in the context of an internal study. In this connection, it was found that a quotient of the benzene and CO contents in the smoke is best suited for describing the adsorption of gas phase components. In this quotient, the unit of the benzene content is given by definition in μg/cigarette while the unit of the CO content is given by definition in mg/cigarette. On the one hand, the influence of filter ventilation and strand ventilation is compensated by the standardization to the CO content. On the other hand, while the benzene content in the gas phase is to a large extent independent of the tobacco mixture, it can be lastingly influenced by adsorbents, whereas CO is practically unabsorbed. In that which follows, this quotient is designated Q1 for data which were determined under ISO smoking conditions. If the data were determined under intense smoking conditions, the quotient is designated Q2. A low value for Q1 or Q2 is consequently a measure of a high gas phase reduction.

Another advantage is to be seen in the fact that the determination of CO in cigarette smoke is described by international standards. As a constituent of what are termed the "Hoffman analytes" benzene is likewise frequently determined in the smoke. Other information in this regard can be found, for example in M. E. Counts et al. J. Regulatory Toxicology and Pharmacology 39 (2004), 111-134.

The same document also contains benzene and CO data for a selection of cigarette brands from different countries, a selection of which are listed in Table 1. Our own investigations were used to determine the filter type. It turns out that, at values of from 3.5 to 5.5, the quotient is relatively constant for a broad range of products having a conventional filter composed of cellulose acetate (CA). On the other hand, lower values of between 1.8 and 3.0 are found in the case of products containing an active charcoal (AC) filter.

TABLE 1

| Brand | Filter | CO [mg/cig] | Benzene [μg/cig] | Q1 (benzene/CO) |
|---|---|---|---|---|
| Marlboro KS (US) | CA | 12.9 | 45.2 | 3.5 |
| Marlboro KS (EU) | CA | 11.5 | 43.6 | 3.8 |
| Marlboro 100 (EU) | CA | 11.6 | 43.8 | 3.8 |
| Marlboro KS Lights (EU) | CA | 6.4 | 25.9 | 4.0 |
| Philip Morris One (EU) | CA | 2.0 | 11.0 | 5.5 |
| Muratti Ambassador (EU) | AC | 7.5 | 17.6 | 2.3 |
| Marlboro KS (Japan) | AC | 11.2 | 24.5 | 2.2 |
| Parliament KS Lights (Japan) | AC | 7.5 | 15.1 | 2.0 |

TABLE 1-continued

| Brand | Filter | CO [mg/cig] | Benzene [μg/cig] | Q1 (benzene/CO) |
|---|---|---|---|---|
| Marlboro KS Lights (Japan) | AC | 6.8 | 12.8 | 1.9 |
| Omni Lights (US) | AC | 13.6 | 23.8 | 1.8 |
| Advance Lights (US) | AC | 9.0 | 27.4 | 3.0 |

According to the invention, the gas phase is specifically influenced such that the ratio Q1 is less than the values which are measured in the case of commercially available cigarettes, i.e. less than 1.5, as measured in accordance with ISO smoking conditions. Q2 is preferably less than 3 as measured in accordance with intense smoking conditions.

The intense smoking conditions (CINT: Canada Intense) correspond to the Health Canada Official Method T-115, "Determination of Tar, Nicotine and Carbon Monoxide in Mainstream Tobacco Smoke", conditions as in section 14 (6) (b) (modified conditions) of the Canadian Federal Tobacco Regulations.

In this method, the cigarette is smoked with an increased inhalation volume (55 ml/2 seconds) and a reduced inhalation pause (28 seconds) while the filter ventilation zone is at the same time completely covered, see http://www.hc-sc.gc.ca/hecs-sesc/tobacco/pdf/T-115e4.pdf.

When reference is made below to ISO smoking conditions, this then refers to the ISO Standard No. 4387. In this standard, the inhalation volume is 35 ml/2 seconds while the inhalation pause is 58 seconds; the filter ventilation zone is not covered.

In the case of the examples which are explained below the cytotoxicity was determined using the method presented at the New Orleans 2002 Coresta congress (Röper, W., Wieczorek, R.: In-vitro cytotoxicity of cigarette mainstream smoke. Evaluation of different cell exposure methods, including "native" smoke aerosol exposure). The tests were carried out using HEP-G2 (human hepatocellular carcinoma) cells. For the tests, serum-free medium was prepared with the gas phase from the cigarettes according to the invention. The cells were then incubated with this medium for 65 h. Proliferation tests were then carried out and EC50 values were determined. EC50 is the effective concentration of a substance or substance mixture which brings about a 50% inhibition of the growth of cells.

Proliferation tests: in the NRU test (neutral red uptake cytotoxicity assay), the proliferation is measured on the basis of the membrane activity of the living cells. NRU test protocols have been published in ECVAM, FRAME, CAAT, INVITOX and ICCVAM. The tests in the examples were carried out in accordance with the INVITOX protocol No. 64 (1992) "The neutral red cytotoxicity assay". In the MTS test (Owen's reagent, Promega kit, cell proliferation assay), the proliferation is measured on the basis of the metabolic activity of the living cells (CellTiter 96® $AQ_{ueous}$ non-radioactive cell proliferation assay (MTS) supplied by Promega GmbH).

In the examples, the gas phase components in the mainstream smoke of the filter cigarettes were determined by means of GC-FID. For this, a 20-channel smoking machine supplied by Borgwaldt (RM 20/CS) was equipped with 20 cigarettes and with a 92 mm glass fibre filter for separating off the moist condensate. The test: cigarettes had previously been conditioned in accordance with ISO 3402. 20 cigarettes were smoked in accordance with ISO 3308, the moist condensate was separated off on the glass fibre filter and the gas phase was conducted to the pump of the smoking machine. Defined inhalations from different cigarettes were taken for the subsequent analysis using a sampling valve and collected in a glass sampling syringe. Immediately after smoking, 6 ml of the gas sample were transferred using a sample loop into the injector of a gas chromatograph (GC), fractionated and detected by means of FID. A test gas comprising methane in nitrogen was used as the internal standard. The GC-FID conditions were as follows: injector temperature, 110° C.; split, 80 ml/min; carrier gas helium, 1.7 ml/min; column 0.5 μm DB Wax 60 m×0.32 mm; temperature programme: 20°, 11/min to 28° C.; 2° C./min to 60° C.; 20°/min to 110° C.; FID temperature 200° C.

A quantification was carried out for the following gas phase components: isoprene, acetaldehyde, propionaldehyde, furan, i-butyraldehyde, acetone, acrolein, methylfuran, butanone, methanol, benzene, butenone, dimethylfuran, diacetyl, acetonitrile, hydrogen cyanide and toluene. The results are given in μg of the respective gas phase component per cigarette. The measurement was carried out as a duplicate determination.

The sum of the values of the above-listed gas phase components is termed the total gas phase $G_{tot}$.

NFDPM: Nicotine-free dry particulate matter; is customarily also termed "tar" or condensate value.

The ratio of CO to NFDPM is preferably less than 1.

The TSNA contents in the smoke are based on the NFDPM contents and are preferably less than 15 ng/mg of NFDPM, in particular less than 13 ng/mg of NFDPM. The NO content is preferably less than 50 μg per cigarette.

In the case of the cigarette according to the invention, the quantity of the gas phase substances, preferably described as total gas phase $G_{tot}$, is significantly reduced.

The quotients Q1 and Q2, which describe the ratio of benzene to CO, have declined below the limit values of 1.5 for Q1 (measured in accordance with ISO) and, respectively, 3 for Q2 (measured in accordance with the intense smoking method).

In this connection, the decline in gas phase constituents of the smoke and the quotients Q1 and, respectively, Q2 of the cigarette according to the invention are to a large extent independent of the storage time and of the smoking conditions as well.

It was demonstrated in biomarker studies that, in the case of the filter cigarettes according to the invention, the uptake of gas phase constituents is effectively reduced under everyday conditions as compared with conventional products.

In the case of the cigarette according to the invention, the cytotoxicity of the gas phase, as measured using the NRU and MTS standard tests, is significantly reduced as compared with conventional cigarettes both under ISO smoking conditions and under intense smoking conditions.

The TSNA values in the smoke of the cigarettes according to the invention are low as compared with conventional filter cigarettes, and with this applying both in the case of ISO smoking conditions and in the case of intense smoking conditions. They are preferably less than 50% of the values of the conventional filter cigarettes.

It was furthermore observed that the sensory acceptance of the cigarette according to the invention is at least equivalent to that of a commercially available brand product.

The invention is described in more detail below with the aid of examples.

EXAMPLE 1

A Virginia blend tobacco mixture without additives was prepared for the variant in Example 1. A commercially available cigarette brand containing Virginia blend mixture was examined for comparison.

The tobacco strand was wrapped with a cigarette paper which has a porosity of 50 CU, which was provided with a glow salt content of 1.3% sodium/potassium citrate and whose grammage was 22 mg/m$^2$.

The strand was attached to a filter consisting of two parts, with 75 mg of active charcoal having been introduced into its strand-end filter part of 15 mm in length. The mouth-end filter part was made of cellulose acetate.

The filter was surrounded by a filter wrapping paper. The tobacco strand was connected to the filter by a binding paper. A filter ventilation of 25% was established using an online laser device.

Table 2 shows the values which were determined both for cigarettes according to the invention and for the comparison cigarettes, with the cigarettes being smoked either in accordance with ISO conditions or in accordance with intense conditions (CINT) in which the ventilation zone was covered.

The total gas phase $G_{tot}$ is clearly lower in the case of the cigarette according to the invention than in the case of the comparison cigarette. At 1.4, Q1 is below the desired limit value of 1.5 and, at 2.5, Q2 is below the desired limit value of 3.

In addition, the product according to the invention was compared, in a field study, with a commercially available product having similar nicotine, condensate and CO values. In this study, 50 smokers first of all smoked the comparison product (commercially available cigarette containing a comparable tobacco mixture), then smoked the product according to the invention for six weeks and, in conclusion, smoked the comparison product once again for six weeks.

The test subjects lived under everyday conditions; there were no restrictions with regard to consumption and smoking behaviour. Every three weeks, the test subjects were examined for the contents of different biomarkers (metabolic products of smoke constituents) in body fluids.

It was found that the uptake of nicotine was at the same level for both the comparison product and the test product, that is no change in smoking behaviour had occurred. On the other hand, a marked reduction of biomarkers for gas phase constituents in the smoke was detected during the period in which the product according to the invention was smoked.

TABLE 2

| | | Example 1 | | | |
|---|---|---|---|---|---|
| Smoking standard | | Cigarette according to the invention ISO | Cigarette according to the invention CINT | Comparison ISO | Comparison CINT |
| Filter ventilation | % | 25 | 0 | 25 | 0 |
| Active charcoal quantity | mg | 75 | 75 | 0 | 0 |
| Cigarette paper grammage | g/m$^2$ | 22 | 22 | 25 | 25 |
| Cigarette paper porosity | CU | 50 | 50 | 54 | 54 |
| Glow salt content in the cigarette paper | % | 1.3 | 1.3 | 0.7 | 0.7 |
| Nicotine in the smoke | mg/cig | 0.87 | 2.07 | 0.85 | 2.05 |
| NFDPM | mg/cig | 9.3 | 25.4 | 10.6 | 28.6 |
| CO | mg/cig | 8.4 | 23.6 | 10.9 | 29.9 |
| CO/NFDPM | | 0.90 | 0.93 | 1.03 | 1.05 |
| Total gas phase | µg/cig | 910 | 4219 | 1998 | 5512 |
| Benzene | µg/cig | 12 | 60 | 41 | 99 |
| Q = benzene/CO | | 1.4 | 2.5 | 3.8 | 3.3 |

EXAMPLE 2

An American blend tobacco mixture was also prepared entirely without additives for the version in Example 2. A commercially available cigarette brand containing American blend mixture was investigated for comparison.

The individual results for the two cigarettes are compiled in Table 3.

TABLE 3

| | | Example 2 | | | |
|---|---|---|---|---|---|
| Smoking standard | | Cigarette according to the invention ISO | Cigarette according to the invention CINT | Comparison ISO | Comparison CINT |
| Filter ventilation | % | 18 | 0 | 46 | 0 |
| Active charcoal quantity | mg | 75 | 75 | 0 | 0 |
| Cigarette paper grammage | g/m$^2$ | 35 | 35 | 25 | 25 |
| Cigarette paper porosity | CU | 320 | 320 | 33 | 33 |
| Glow salt content in the cigarette paper | % | 2.0 | 2.0 | 0.7 | 0.7 |
| Nicotine in the smoke | mg/cig | 0. 62 | 1.68 | 0.54 | 1.58 |
| NFDPM | mg/cig | 6.3 | 19.3 | 6.2 | 21.7 |
| CO | mg/cig | 5.6 | 16.9 | 6.9 | 24.3 |
| CO/NFDPM | | 0.89 | 0.88 | 1.11 | 1.12 |
| Total gas phase | µg/cig | 307 | 2312 | 1305 | 5438 |
| Benzene | µg/cig | 2.8 | 24.4 | 27.7 | 92.7 |
| Q = benzene/CO | | 0.5 | 1.4 | 4.0 | 3.8 |

The filter consisted of a filter section composed of pure cellulose acetate and of a strand-end section of 15 mm in length which was composed of cellulose acetate into which 5 mg of active charcoal had been introduced per mm such that the filter contained a total of 75 mg of active charcoal.

The cigarette paper of the cigarette according to the invention had a porosity of 320 CU and a grammage of 35 g/m$^2$.

For this version, the glow salt content was 2.0% sodium/potassium citrate.

The filter was enclosed in a filter wrapping paper. The tobacco strand was connected to the filter by means of a binding paper.

A filter ventilation of 18% was established on an on-line laser device.

For both versions, this choice of the design parameters resulted in the desired reduction in the gas phase values both under ISO smoking conditions and under intense smoking conditions (CINT).

These design parameters also made it possible to markedly reduce the Q1 and Q2 quotients.

EXAMPLE 3

Cigarettes according to Example 1 were stored for a period of 12 months. After every 3 months, the gas phase values were determined once again under ISO smoking conditions. It was observed that the efficacy of the cigarette filters in regard to the total gas phase $G_{tot}$ values remained to a very large extent stable. After 3 months, the quantity of the total gas phase was only 3.6% more that the quantity of the total gas phase which was determined on freshly prepared filter cigarettes. After 6 months, a further increase of only 4.1% was determined. The decrease in efficacy by less than 10% within 6 months is extremely advantageous.

TABLE 4

| Example 3 | | 0 | 3 months | 6 months |
|---|---|---|---|---|
| Total gas phase | µg/cig | 910 | 943 | 982 |

EXAMPLE 4

The cigarettes according to Example 4 correspond to the cigarettes according to Example 1. The tobacco in the tobacco strand was chosen such that the TSNA content was less than 1 µg/g of tobacco, namely 0.4 µg/g of tobacco.

TABLE 5

| | | Example 4 | |
|---|---|---|---|
| Smoking standard | | Cigarette according to the invention ISO | Comparison ISO |
| Tobacco chloride | % | 0.4 | 0.9 |
| Tobacco nitrate | % | 0.2 | 0.5 |
| Tobacco TSNA | µg/g | 0.4 | 1.1 |
| Tobacco brand | | Virginia | Virginia |
| Smoke NO | µl/cig | 42.00 | 71.00 |
| Smoke TSNA | ng/cig | 65.0 | 142.0 |
| Smoke TSNA | ng/mg of NFDPM | 7.0 | 15.4 |

The smoke of the cigarettes according to Example 1 was examined with regard to its TSNA values and NO values. In Table 5, these values are compared with those of a conventional cigarette. The TSNA content in the smoke is 54% lower than in the conventional cigarette.

EXAMPLE 5

The experimental cigarettes according to Examples 1 and 2 were smoked both under ISO smoking conditions and under intense smoking conditions and the cytotoxicity of the gas phase in accordance with NRU and MTS tests was determined.

EC50 values of the gas phases were determined. The toxicity values are given in percentage decrease in the toxicity based on a commercially available comparison cigarette having comparable NFDPM values and containing comparable tobacco mixtures. It can be seen from the table that, in all the samples investigated, the cyto-toxicity of the experimental cigarettes is markedly lower than that of the appurtenant comparison cigarettes. The cigarettes were smoked in accordance with ISO conditions and the gas phase was analysed. In addition, the cigarettes were smoked in accordance with intense conditions and the gas phase was analysed. Under both smoking conditions, the cytotoxicity was markedly lower in the case of the cigarettes according to the invention than in the case of the comparison.

TABLE 6

| | Example 1 | | Example 2 | |
|---|---|---|---|---|
| Toxicity | ISO | CINT | ISO | CINT |
| Decrease in membrane toxicity (NRU) in % | 45.0 | 47.0 | 95.0 | 72.0 |
| Decrease in metabolic toxicity (MTS) in % | 76.8 | 52.2 | 85.0 | 77.0 |

EXAMPLE 6

An American blend tobacco mixture was likewise prepared entirely without additives for the version in Example 6. A commercially available Ultra cigarette brand was examined as comparison.

The individual results for the two cigarettes are compiled in Table 7.

The filter consisted of a filter section composed of pure cellulose acetate and a strand-end section of 15 mm in length which was composed of cellulose acetate into which 5 mg of active charcoal had been introduced per mm such that the filter contained a total of 75 mg of active charcoal.

The cigarette paper in the cigarette according to the invention had a porosity of 50 CU and a grammage of 22 g/m$^2$.

The glow salt content for this version was 1.3% sodium/potassium citrate.

The filter was enclosed in a filter wrapping paper. The tobacco strand was connected to the filter by means of a binding paper.

A filter ventilation of 60% was established on an on-line laser device.

This choice of design parameters resulted in the desired reduction in the gas phase values both under ISO smoking conditions and under intense smoking conditions (CINT).

These design parameters also made it possible to markedly reduce the Q1 and Q2 quotients.

TABLE 7

| | | Example 6 | | | |
|---|---|---|---|---|---|
| Smoking standard | | Cigarette according to the invention ISO | Cigarette according to the invention CINT | Comparison ISO | Comparison CINT |
| Filter ventilation | % | 60 | 0 | 69 | 0 |
| Active charcoal quantity | mg | 75 | 75 | 0 | 0 |
| Cigarette paper | g/m$^2$ | 22 | 22 | 25 | 25 |

TABLE 7-continued

| Smoking standard | | Example 6 | | | |
|---|---|---|---|---|---|
| | | Cigarette according to the invention ISO | Cigarette according to the invention CINT | Comparison ISO | Comparison CINT |
| grammage | | | | | |
| Cigarette paper porosity | CU | 50 | 50 | 49 | 49 |
| Glow salt content in the cigarette paper | % | 1.3 | 1.3 | 1.0 | 1.0 |
| Nicotine in the smoke | mg/cig | 0.44 | 2.37 | 0.28 | 1.68 |
| NFDPM | mg/cig | 3.6 | 24.0 | 2.6 | 21.2 |
| CO | mg/cig | 2.3 | 20.0 | 2.8 | 23.9 |
| CO/NFDPM | | 0.64 | 0.83 | 1.08 | 1.13 |
| Total gas phase | µg/cig | 88 | 2873 | 680 | 5381 |
| Benzene | µg/cig | 1.3 | 36.9 | 15.4 | 93.2 |
| Q = benzene/CO | | 0.56 | 1.8 | 5.5 | 3.9 |

The invention claimed is:

1. A filter cigarette comprising:

a tobacco rod, a wrapping and a filter, a) said filter including at least one gas phase-active filter part which contains at least one gas phase-reducing substance, with the at least one gas phase-active filter part presenting a length, b) said at least one gas phase-reducing substance being embedded in a filter material matrix, c) said at least one gas phase-reducing substance being introduced in such a quantity that the filter cigarette has a high substance load of at least 75 mg per filter and at least 5 mg/mm of the length of the at least one gas phase-active filter part, d) wherein any filter ventilation exhibited by said filter cigarette is less than or equal to 30%, e) said filter cigarette having an NFDPM value between 4 and 10 mg/cigarette, as measured in accordance with ISO smoking conditions, f) said filter cigarette having a gas phase quotient Q1, defined as (µm of benzene per cigarette)/(mg of CO per cigarette) and measured in accordance with ISO smoking conditions, less than 1.5, g) said tobacco rod including tobacco dry matter, h) wherein any additives contained within said tobacco rod result in the tobacco rod having an additive content of less than 1% based on the tobacco dry matter.

2. The filter cigarette according to claim 1, said filter cigarette having a gas phase quotient Q2, defined as (µm of benzene per cigarette)/(mg of CO per cigarette) and measured in accordance with intense smoking conditions, less than 3.

3. The filter cigarette according to claim 1, said filter being configured to hold an increase in the quotient Q1 to less than 20% over a cigarette storage period of 6 months.

4. The filter cigarette according to claim 1, wherein said tobacco rod does not contain any additives.

5. The filter cigarette according to claim 1, said tobacco rod having a tobacco mixture which contains tobacco selected from the group consisting of Virginia tobacco, Oriental tobacco, and combinations thereof.

6. The filter cigarette according to claim 1, said tobacco rod having a TSNA content less than 2 µg/g of tobacco.

7. The filter cigarette according to claim 1, said tobacco rod having a nitrate content less than 0.4% based on the tobacco dry matter.

8. The filter cigarette according to claim 1, said filter cigarette being configured to emit cigarette smoke during use thereof, wherein an NO content in the smoke is less than 50 µg per cigarette, as measured in accordance with ISO smoking conditions.

9. The filter cigarette according to claim 1, said filter cigarette being configured to emit cigarette smoke during use thereof, wherein a TSNA content in the smoke based on the NFDPM value is less than 15 ng/mg of NFDPM as measured in accordance with ISO smoking conditions.

10. The filter cigarette according to claim 1, said at least one gas phase-reducing substance presenting a surface area of more than 500 m2/g.

11. The filter cigarette according to claim 1, said at least one gas phase-reducing substance being selected from the group consisting of active charcoals, aluminium oxides, aluminium hydroxides, ion exchangers, ion exchange resins, molecular sieves, silica gels, natural minerals, synthetic minerals, magnesium silicates, argillaceous earths, zeolites, bentonites, kieselgur, sepiolite, and combinations thereof.

12. The filter cigarette according to claim 1, said at least one gas phase-reducing substance being introduced in a quantity of at least 82.5 mg per filter and at least 5.5 mg/mm of the length of the at least one gas phase-active filter part.

13. The filter cigarette according to claim 1, said filter cigarette having a total gas phase Gtot less than 1000 µg/cigarette as measured under ISO smoking conditions.

14. The filter cigarette according to claim 1, said filter material matrix including a material selected from the group consisting of cellulose, cellulose derivatives, cellulose acetate, polymers, polyolefins, polypropylene, polyethylene, polyesters, and combinations thereof.

15. The filter cigarette according to claim 1, said filter including a filter material that comprises the filter material matrix, said filter material being selected from the group consisting of fibres, tows, papers, textile webs, non-woven materials, fibrous webs, extrudates, foams, and combinations thereof.

16. The filter cigarette according to claim 1, said filter including a filter material that comprises additives.

17. The filter cigarette according to claim 1, said filter ventilation being at most 25%.

18. The filter cigarette according to claim 1, wherein said filter cigarette does not exhibit any filter ventilation.

19. The filter cigarette according to claim 1, wherein said filter consists of more than one part.

20. The filter cigarette according to claim 1, said wrapping including cigarette paper with a porosity that is at least 40 CU.

21. The filter cigarette according to claim 1, said wrapping including cigarette paper with a porosity that is at least 300 CU.

22. The filter cigarette according to claim 1,
said wrapping including cigarette paper with a glow salt content in the cigarette paper being at least 1% based on the weight of the cigarette paper.

23. The filter cigarette according to claim 1,
said wrapping including cigarette paper, with a grammage of the cigarette paper being less than 25 g/m2.

24. The filter cigarette according to claim 1,
said NFDPM value being between 4 and 7 mg per cigarette as measured in accordance with ISO smoking conditions.

25. The filter cigarette according to claim 1,
said NFDPM value being between 4 and 6 mg per cigarette as measured in accordance with ISO smoking conditions.

26. The filter cigarette according to claim 1,
said NFDPM value being between 10 and 32 mg per cigarette as measured in accordance with CINT smoking conditions.

* * * * *